US005348265A

United States Patent [19]

Burg

[11] Patent Number: 5,348,265

[45] Date of Patent: Sep. 20, 1994

[54] AIR CUSHION SUPPORTED SECONDARY STRUCTURE

[76] Inventor: Donald E. Burg, 15840 SW. 84 Ave., Miami, Fla. 33157

[21] Appl. No.: 53,910

[22] Filed: Apr. 27, 1993

Related U.S. Application Data

[63] Continuation-in-part of Ser. No. 180,246, Apr. 11, 1988, abandoned, which is a continuation-in-part of Ser. No. 514,123, Apr. 25, 1990, abandoned, which is a continuation-in-part of Ser. No. 804,235, Dec. 5, 1991, Pat. No. 5,207,408.

[51] Int. Cl.[5] ..... B63B 17/00

[52] U.S. Cl. ..... 248/550; 33/518; 114/284; 248/562

[58] Field of Search ..... 248/550, 560, 562, 564, 248/603, 610, 618, 631, 637, 646, 660; 33/318; 180/41; 114/71, 203, 284; 74/5.22

[56] References Cited

U.S. PATENT DOCUMENTS

| | | | |
|---|---|---|---|
| 3,410,357 | 11/1968 | Summers | 74/5.22 |
| 3,731,543 | 5/1973 | Gates | 33/318 |
| 3,731,544 | 5/1973 | Acker | 74/5.22 |
| 4,351,262 | 9/1982 | Matthews | 114/284 |
| 4,392,445 | 7/1983 | Burg . | |
| 4,477,045 | 10/1984 | Karasawa | 248/550 |
| 4,587,918 | 5/1986 | Burg . | |
| 4,589,620 | 5/1986 | Sakamoto | 248/550 |
| 4,735,164 | 4/1988 | Burg . | |
| 4,739,719 | 4/1988 | Burg . | |

FOREIGN PATENT DOCUMENTS

| | | | |
|---|---|---|---|
| 21696 | 8/1961 | German Democratic Rep. | 114/71 |
| 92441 | 6/1982 | Japan . | |
| 221786 | 12/1983 | Japan . | |
| 221788 | 12/1983 | Japan . | |
| 221789 | 12/1983 | Japan . | |
| 1100123 | 1/1968 | United Kingdom | 248/562 |

*Primary Examiner*—J. Franklin Foss
*Attorney, Agent, or Firm*—R. J. Van Der Wall

[57] ABSTRACT

This invention consists of a parent structure and a stabilized supported secondary structure with one or more supporting pressurized gas cushions disposed between them. Selective control of pressures in the supporting pressurized gas cushions insures that the secondary structure is maintained in a desired orientation regardless of the orientation of the parent structure. This particularly attractive for stabilization of passenger cabins in boats but is also applicable of trains, airplanes, and even non-vehicular applications where there is tilting or other movement of the parent structure. An attractive application is to gas cushion supported marine craft since such craft already have a gas pressurization system in place. A pressure regulating device controls pressures in the supporting gas cushions. The pressure regulating device receives direction from a controller that utilizes data on secondary structure orientation supplied by an orientation sensing device, preferably a gyroscope, in mechanical communication with the secondary structure. There is normally a pivoting mechanism disposed between the parent structure and the secondary structure to prevent excessive movement of the secondary structure.

25 Claims, 3 Drawing Sheets

AIR CUSHION SUPPORTED SECONDARY STRUCTURE

CROSS REFERENCE TO OTHER APPLICATIONS

This application is a continuation-in-part to applicant's earlier applications, Ser. No. 180,246 filed Apr. 11, 1988, now abandoned, Ser. No. 514,123 filed Apr. 25, 1990, now abandoned, and Ser. No. 804,235 filed Dec. 5, 1991, now U.S. Pat. No. 5,207,408 issued May 4, 1993.

BACKGROUND OF THE INVENTION

The instant invention presents improvements to applicant's issued U.S. Pat. No. 5,207,408. The BACKGROUND TO THE INVENTION section of that issued patent gives a rather thorough background history of prior art secondary structure stabilization systems so that will not be repeated here.

The instant invention focuses on multiple secondary structure supporting gas cushions that, by regulation of their gas pressures, can accomplish orientation control of the secondary structure relative to a parent structure. The combined upper surface areas of the secondary structure supporting gas cushions are equal to a majority of a lower surface area of the secondary structure and carry a majority of secondary structure weight. This clearly defines over the small gas shock absorbers and vehicle levelers as used in some automobiles.

It is to be noted that the term gas is used rather than air throughout this application. This is done to simplify things and to cover situations where engine exhaust gas, industrial gases from pressurized gas containers, and the like can be used to supply at least part of the gas to the gas cushions.

There is normally a pivoting connector between the parent and the secondary structures to maintain the relative positioning between those structures in the instant invention. The simplest version of a pivoting connector is hinge like; however, a ball and socket device can also be used for maximum freedom of secondary structure orientation control. It is also anticipated that actuators or shock absorbers can be used to assist the secondary structure supporting gas cushions.

An ideal application of this instant invention is in conjunction with applicant's Air Ride boat or other gas cushion supported boat technology. In such applications, the parent structure or main hull is primarily supported by a pressurized gas cushion disposed in a cavity in the underside of the boat. It is therefore easy to obtain pressurized gas from either the pressurized cavity and/or directly from the boat's powered blowers for use in the secondary structure supporting gas cushions.

Ways to control the pressure in the secondary structure supporting gas cushions are presented. These include a master control valve or pressure regulating device, and a controller that directs its operation, that regulates pressures in multiple secondary structure supporting gas cushions and thereby controls orientation of the secondary structure. Further presented is a highly efficient gas cushion venting system whereby gas vented from a gas cushion can be recycled back into an inlet of a gas pressurization means such as a powered blower.

SUMMARY OF THE INVENTION

With the foregoing in mind, it is the principal object of the instant invention to provide a simple stabilized supported secondary structure that is applicable to use with a variety of primary or parent structures. Some examples of parent structures are boat hulls, trains, busses, and airplanes.

A primary object of the instant invention is to provide multiple pressurized gas cushions disposed between a supported secondary structure and a parent structure. These gas cushions support a majority of secondary structure weight. Control of pressure in the separate multiple pressurized gas cushions controls orientation of the secondary structure such that it can remain stable and level while the parent structure is moving about.

It is a related primary object of the invention that the sum of upper surface areas of said supporting gas cushions be equal to a majority of a secondary structure lower surface area to thereby provide large pressurized gas supporting areas. This insures low cushion pressures and a cushioned vibration free ride for the contents of the secondary structure.

Another related object of the invention is that a gas pressurization means, such as a powered blower, can be used to provide pressurized gas to the gas cushions.

A further object of the invention is that gas supplied to the secondary structure supporting gas cushions can be regulated by a pressure regulating device.

It is related object of the invention that pressure in the secondary structure supporting gas cushions can be vented by a flow control device.

It is a further related object of the invention that gas vented from the secondary structure supporting gas cushions can be directed back to an inlet of a gas pressurization means thereby establishing a high efficiency and very rapid responding system.

Yet another object of the invention is that a controller can be used to direct operation of a pressure regulating device.

A directly related object of the invention is that a controller receives input data on orientation of the secondary structure from an orientation sensing device, such as a gyroscope, in mechanical communication with the secondary structure.

It is also an object of the invention that it can be used in conjunction with any type of machine including movable vehicles and relatively stationary machines that experience only tilting or rolling types of movement.

It is a further object of the invention that it can be used in conjunction with a gas cushion supported vehicle such as applicant's Air Ride Boat inventions.

it is a directly related object of the invention that pressurized gas from a vehicle's gas cushion can be utilized to supply gas to the secondary structure supporting gas cushions.

It is another object of the invention that a seal may be utilized around the periphery of the secondary structure.

It is a further object of the invention that a pivoting connector can be utilized to connect the parent and the supported structures. This places the secondary structure in a known relation to the parent structure both fore and aft and side to side.

It is an optional but directly related object of the invention that the pivoting connector can be a ball and socket.

It is also an optional but related object of the invention that the pivoting connector can be a hinge like device.

The invention will be better understood upon reference to the drawings and detailed description of the invention which follow in which:

DETAILED DESCRIPTION

With reference to each of the aforementioned figures in turn, and using like numerals to designate similar parts throughout the several views, a preferred embodiment and several alternative embodiments will now be described.

Figure 1:
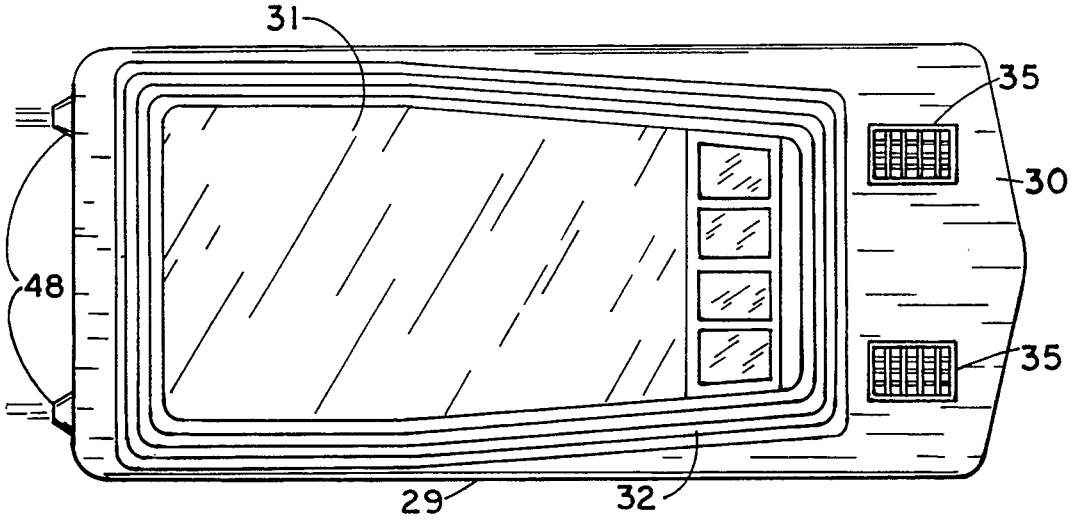
FIG. 1 is a top view of a marine vehicle to the instant invention that shows a parent structure or boat hull and a secondary structure which in this case is a passenger compartment. Also shown are blower inlets.

FIG. 1 presents a top plan view of a marine vehicle 29 to the instant invention showing the hull or parent structure 30 and supported structure 31. Also shown are a secondary structure peripheral seal 32, blower gas inlets 35, and propulsors 48.

Figure 2:
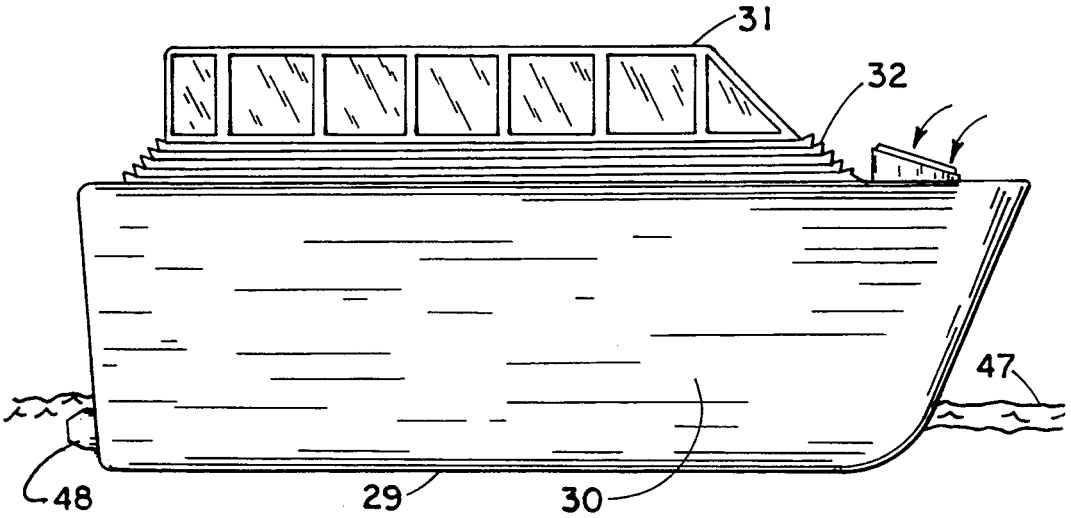
FIG. 2 is a profile view of the same marine vehicle as shown in FIG. 1 that also shows the parent structure, secondary structure and blower inlets.

FIG. 2 shows a profile view of the same marine vehicle 29 as shown in FIG. 1. It shows the same items as FIG. 1 but with the addition of a waterline 47.

Figure 3:
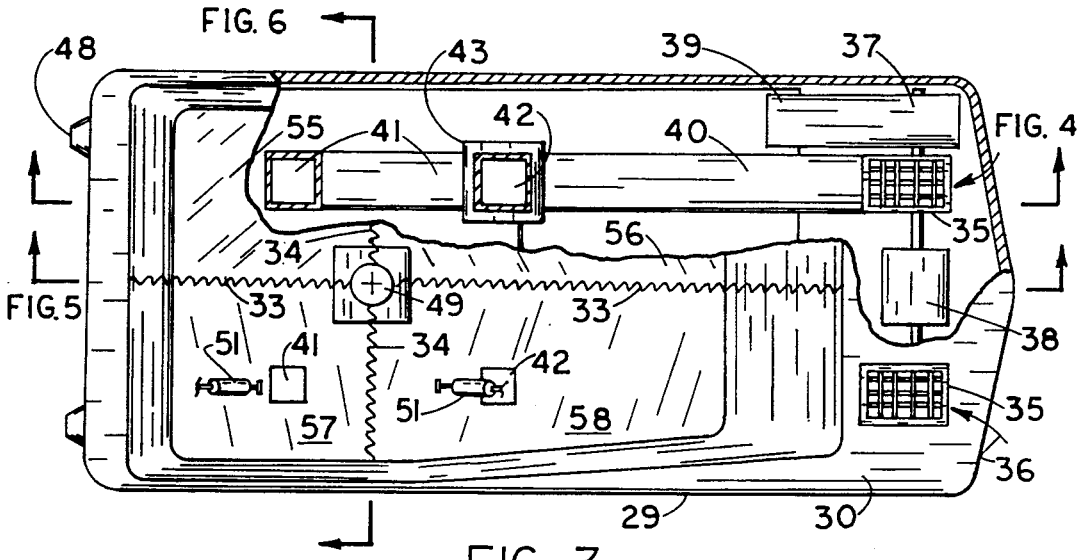
FIG. 3 is a partial cutaway top view of the parent structure or boat hull only that shows a pivoting connector and other details including a gas pressurizing blower, actuators, and a pressure regulating device.

FIG. 3 is a partial cutaway top plan view of the parent structure 30 shown with portions of the deck covering removed in the upper portion of the figure. This shows separate gas cushions 55, 56, 57, 58, longitudinal cushion separating seal 33, transverse cushion separating seal 34, and two gas ducts 41, 42. Also shown are actuators 51 and a pivoting connector 49 which in this instance is a ball portion of a ball and socket that connect the parent structure 30 to the secondary structure. The secondary structure is not shown in FIG. 3.

Portions of the pressurized gas supply system shown include a blower 37, blower drive motor 38, blower inlets 35, and a blower discharge duct 39 that discharges to a parent structure supporting gas cushion in this instance. The parent structure supporting gas cushion is not shown in FIG. 3 but is shown as item 45 in following FIGS. 4 through 7. Further shown in FIG. 3 are gas flow ducts 40, 41, 42 that are connected to flow selector and pressure control valve 43 which is normally hereafter referred to as a pressure regulating device.

Figure 4:
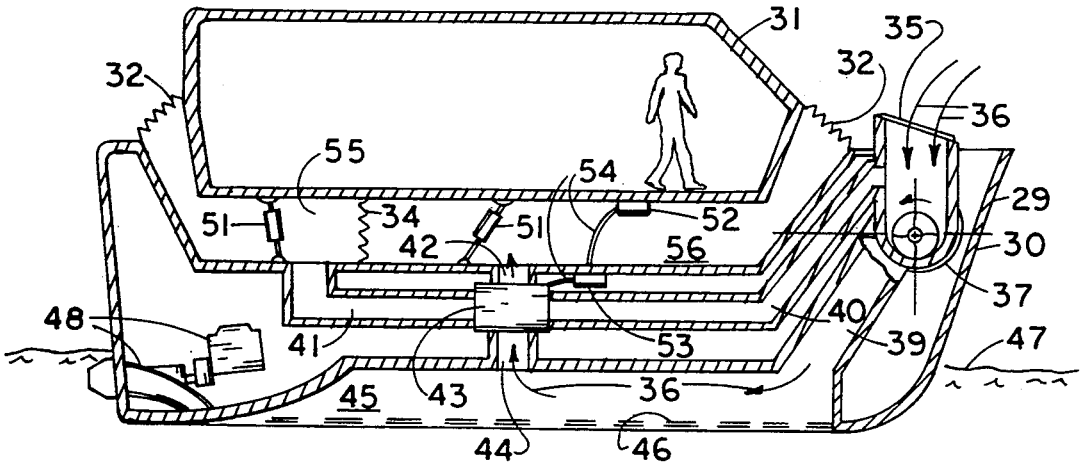
FIG. 4 is a longitudinal cross sectional view, as taken through line 4—4 of FIG. 3, that shows internal workings of a gas pressurization blower, ducting, control valve or pressure regulating device, and parent and secondary structure supporting gas cushions.

FIG. 4 is a cross sectional view, as taken through line 4—4 of FIG. 3, that illustrates direction of gas flow and its functions in this version of the instant invention. Gas enters the blower 37 as shown by gas flow arrows 36, is pressurized by the blower 37 and then discharged through blower discharge duct 39 to parent structure supporting gas cushion 45 which is bounded on its lower side by a gas cushion waterline 46. A duct 44 then leads to the flow control valve 43. Pressurized gas is selectively supplied to or vented from an aft gas cushion 55 and/or a forward gas cushion 56 through ducts 41 and 42 by the flow control valve 43. The pressure regulating device 43 receives its direction for operation from a control module 53 that, prior to directing the pressure regulating device 43, received and processed data on secondary structure 31 orientation from an orientation sensing device 52 which is preferably a gyroscope but can also be other forms of commercially available orientation sensing devices.

It is also possible to utilize the instant invention on other vehicles including non-gas cushion supported boats, buses, trains, airplanes, and the like. In such case, a pressurized gas supply source such as blower 37 can simply discharge directly into the pressure regulating device 43. It is to be noted also that a gas vent return duct 40 to the blower inlet 35 is shown as that approach makes for maximum efficiency and most rapid response. However, it is certainly within the scope of the instant invention to vent to atmosphere or otherwise if desired rather than back to a blower inlet 35.

Figure 5:
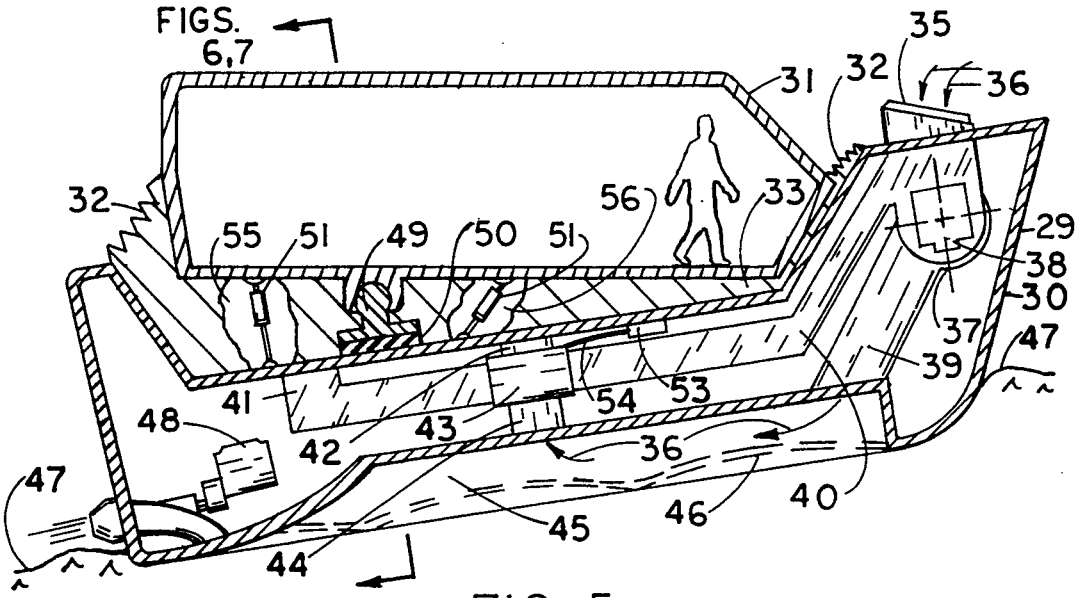
FIG. 5 is a longitudinal centerline cross sectional view, as taken through line 5—5 of FIG. 3, that shows the secondary structure level and the parent structure pitched up by its bow. This view also shows a pivoting connector that connects the parent and the supported structure. Other items shown are similar to those presented in the preceding discussion of FIG. 4.

FIG. 5 is a cross sectional view, as taken through line 5—5 of FIG. 3, that shows the parent structure 30 in a pitch up by the bow orientation but with the supported structure 31 level and stable. In such case, the flow control valve has supplied more gas to an aft gas cushion 55 and vented gas from a forward gas cushion 56. This unbalancing of gas pressures in forward and aft gas cushions and hence unbalancing of lift forces forward and aft of a pivot 49 yields the primary resultant force that keeps the secondary structure 31 level and stable.

It is an intended part of the instant invention that side to side or transverse movement of the parent structure 30 can also be accounted for in a preferred embodiment of the invention. This is accomplished by use of gas cushions disposed, at least primarily, to opposite sides of the secondary structure 31.

Figure 6:
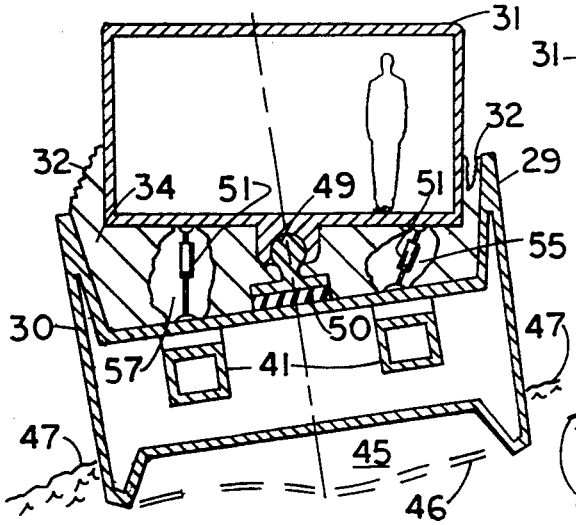
FIG. 6 is a transverse cross sectional view, as taken through line 6—6 of FIG. 5, that shows the parent structure in a severe roll condition but with the supported structure still level. This is made possible by the optional ball and socket pivot connector connecting the parent and the supported structure.

FIG. 6 is a transverse cross sectional view, as taken through line 6—6 of FIG. 5, that shows the pivot as a ball and socket 49 that allows free movement of the secondary structure 31 in both fore and aft pitch and side to side roll. In this instance, the pivot 49 is mounted on a resilient mount 50 to reduce transmission of engine and other vibration from the parent structure 30 to the supported structure 31.

Figure 7:
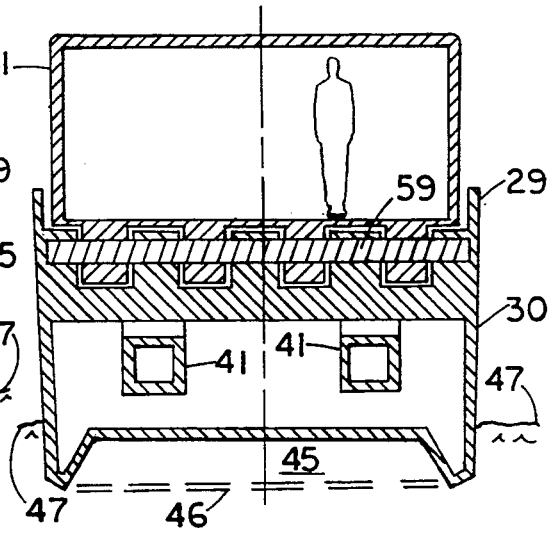
FIG. 7 is a transverse cross sectional view, as taken through line 7—7 of FIG. 5, that shows a pivot that is a hinge like device. This hinge like device offers a simple strong connector but does not offer level orientation of the supported structure if the parent structure is in a severe roll condition. However, this design is preferred, because of its simplicity, in vessels such as applicant's Air Ride boat inventions that are inherently stable in roll due to their very wide beams.

FIG. 7 presents a transverse cross sectional view, as taken through line 7—7 of FIG. 5, where the pivot is a simple hinge 59. This is a simpler and more solid approach that presented in FIG. 6 but does not offer roll control. However, it is well suited for wide beam gas cushion boats, such as applicant's Air Ride Boat inventions, where roll in heavy seas is not a significant factor.

While the invention has been described in connection with a preferred and several alternative embodiments, it will be understood that there is no intention to thereby limit the invention. On the contrary, there is intended to be covered all alternatives, modifications and equivalents as may be included with the spirit and scope of the invention as defined by the appended claims, which are the sole definition of the invention.

What I claim is:

1. Apparatus to provide support for a secondary structure relative to a parent structure comprising:

multiple secondary structure supporting gas cushions disposed, at least in part, between the secondary structure and the parent structure with a sum of upper surface areas of said secondary structure supporting gas cushions equaling a majority of a secondary structure lower surface area, a gas pressurization means for supplying pressurized gas to said secondary structure supporting gas cushions, and a gas pressure regulating device to control gas pressures in at least one of said secondary structure supporting gas cushions to thereby provide orientation control of the secondary structure relative to the parent structure.

2. The secondary structure support and stabilization apparatus of claim 1 wherein operation of the gas pressure regulating device is directed by a controller with said controller receiving data inputs from an orientation sensing device in mechanical communication with the secondary structure.

3. The secondary structure support and stabilization apparatus of claim 1 wherein pressurized gas can be vented from at least one of the secondary structure supporting gas cushions.

4. The secondary structure support and stabilization apparatus of claim 3 wherein pressurized gas vented from one of the secondary structure supporting gas cushions is directed to the gas pressurization means.

5. The secondary structure support and stabilization apparatus of claim 1 which further comprises a seal terminating proximal to and extending proximal a majority of a length of an outer periphery of a lower surface of said secondary structure with said seal in mechanical communication with the parent structure.

6. The secondary structure support and stabilization apparatus of claim 1 which further comprises a pivoting connector disposed between the parent structure and the secondary structure.

7. The secondary structure support and stabilization apparatus of claim 6 wherein said pivoting connector is, at least in part, a ball and socket.

8. The secondary structure support and stabilization apparatus of claim 6 wherein said pivoting connector is, at least in part, a hinge like device.

9. The secondary structure support and stabilization apparatus of claim 1 which further comprises a parent structure supporting gas cushion disposed, at least partially, between the parent structure and a supporting medium of said parent structure and whereby pressurized gas can pass between at least one of said secondary structure supporting gas cushions and the parent structure supporting gas cushion.

10. Apparatus to provide support for a secondary structure relative to a parent structure comprising:

multiple secondary structure supporting gas cushions disposed, at least in part, between the secondary structure and the parent structure with a sum of upper surface areas of said supporting gas cushions equaling a majority of a secondary structure lower surface area, a parent structure supporting gas cushion supplied with pressurized gas by a gas pressurization means and disposed, at least partially, between the parent structure and a supporting medium of said parent structure and whereby pressurized gas can pass between at least one of said secondary structure supporting gas cushions and the parent structure supporting gas cushion.

11. The secondary structure support and stabilization apparatus of claim 10 which further comprises gas pressure regulating means to control gas pressures in at least one of said secondary structure supporting gas cushions to thereby provide orientation control of the secondary structure relative to the parent structure.

12. The secondary structure support and stabilization apparatus of claim 11 wherein operation of the gas pressure regulating device is directed by a controller with said controller receiving data inputs from an orientation sensing device in mechanical communication with the secondary structure.

13. The secondary structure support and stabilization apparatus of claim 10 wherein pressurized gas can be vented from at least one of the secondary structure supporting gas cushions.

14. The secondary structure support and stabilization apparatus of claim 13 wherein pressurized gas vented from at least one of the secondary structure supporting gas cushions is directed to the gas pressurization means.

15. The secondary structure support and stabilization apparatus of claim 10 which further comprises a pivoting connector disposed between the parent structure and the secondary structure.

16. The secondary structure support and stabilization apparatus of claim 15 wherein said pivoting connector is, at least in part, a hinge like device.

17. The secondary structure support and stabilization apparatus of claim 10 which further comprises a seal terminating proximal to and extending proximal a majority of a length of an outer periphery of a lower surface of said secondary structure with said seal in mechanical communication with the parent structure.

18. Apparatus to provide support for a secondary structure relative to a parent structure comprising:

multiple secondary structure supporting gas cushions disposed, at least in part, between the secondary structure and the parent structure with a sum of upper surface areas of said supporting gas cushions equaling a majority of a secondary structure lower surface area, and a pivoting connector disposed between the parent structure and the secondary structure.

19. The secondary structure support and stabilization apparatus of claim 18 wherein said pivoting connector is, at least in part, a ball and socket.

20. The secondary structure support and stabilization apparatus of claim 18 wherein said pivoting connector is, at least in part, a hinge like device.

21. The secondary structure support and stabilization apparatus of claim 18 which further comprises pressure regulating means to control gas pressures in said supporting gas cushions to thereby provide orientation control of the secondary structure relative to the parent structure.

22. The secondary structure support and stabilization apparatus of claim 21 wherein operation of the gas pressure regulating device is directed by a controller with said controller receiving data inputs from an orientation sensing device in mechanical communication with the secondary structure.

23. The secondary structure support and stabilization apparatus of claim 21 wherein pressurized gas can be vented through a pressure regulating device from the secondary structure supporting gas cushion.

24. The secondary structure support and stabilization apparatus of claim 18 which further comprises a seal terminating proximal to and extending proximal a majority of a length of an outer periphery of a lower surface of said secondary structure with said seal in mechanical communication with the parent structure.

25. The secondary structure support and stabilization apparatus of claim 18 which further comprises a parent structure supporting gas cushion disposed, at least partially, between the parent structure and a supporting medium of said parent structure and whereby pressurized gas can pass between at least one of said secondary structure supporting gas cushions and the parent structure supporting gas cushion.

* * * * *